US010765275B2

(12) United States Patent
Sawabe et al.

(10) Patent No.: US 10,765,275 B2
(45) Date of Patent: Sep. 8, 2020

(54) HAND DRYER

(71) Applicant: MITSUBISHI ELECTRIC CORPORATION, Chiyoda-ku, Tokyo (JP)

(72) Inventors: Kenji Sawabe, Tokyo (JP); Toshihiko Horii, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 83 days.

(21) Appl. No.: 15/559,185

(22) PCT Filed: Sep. 1, 2015

(86) PCT No.: PCT/JP2015/074876
§ 371 (c)(1),
(2) Date: Sep. 18, 2017

(87) PCT Pub. No.: WO2016/163042
PCT Pub. Date: Oct. 13, 2016

(65) Prior Publication Data

US 2018/0070783 A1 Mar. 15, 2018

(30) Foreign Application Priority Data

Apr. 7, 2015 (JP) ..... 2015-078248

(51) Int. Cl.
*F26B 25/10* (2006.01)
*A47K 10/48* (2006.01)
(Continued)

(52) U.S. Cl.
CPC ..... *A47K 10/48* (2013.01); *B05B 1/262* (2013.01); *F26B 21/004* (2013.01)

(58) Field of Classification Search
CPC ..... F26B 21/004; F26B 21/028; B05B 1/26; B05B 1/262; B05B 1/265; B05B 1/267
(Continued)

(56) References Cited

U.S. PATENT DOCUMENTS 5,974,685 A * 11/1999 Hironaka ..... A47K 10/48 34/202
2012/0027389 A1 2/2012 Klabin
(Continued)

FOREIGN PATENT DOCUMENTS

JP 04-073026 A 3/1992
JP 05-015896 U 3/1993
(Continued)

OTHER PUBLICATIONS

Office Action (Notification of Reasons for Refusal) dated Mar. 20, 2018, by the Japanese Patent Office in corresponding Japanese Patent Application No. 2017-511449, and an English Translation of the Office Action. (5 pages).
(Continued)

*Primary Examiner* — John P McCormack
(74) *Attorney, Agent, or Firm* — Buchanan Ingersoll & Rooney PC

(57) ABSTRACT

A hand dryer includes a nozzle for blowing out an airflow toward a drying space, which is open at the front and the left and right sides so that hands can be freely inserted and withdrawn, and a wind direction changing part that changes a direction of the airflow blown out vertically downward from the nozzle. The wind direction changing part is so positioned as to be shifted rearward in a front-back direction from a position on an extension of a blow direction of the nozzle. While the airflow is being blown out vertically downward from the nozzle, the wind direction changing part and the nozzle do not directly face each other.

12 Claims, 10 Drawing Sheets

(51) Int. Cl.
*B05B 1/26* (2006.01)
*F26B 21/00* (2006.01)

(58) Field of Classification Search
USPC ..... 34/239, 413, 309
See application file for complete search history.

(56) References Cited

U.S. PATENT DOCUMENTS

| | | | | |
|---|---|---|---|---|
| 2013/0232808 | A1 | 9/2013 | Liu et al. | |
| 2014/0208608 | A1* | 7/2014 | Robert | A47K 10/48 34/523 |
| 2014/0212304 | A1* | 7/2014 | Michael | F04D 25/082 417/363 |

FOREIGN PATENT DOCUMENTS

| | | | |
|---|---|---|---|
| JP | 09-056639 | A | 3/1997 |
| JP | 10-099235 | A | 4/1998 |
| JP | 2001-190446 | A | 7/2001 |
| JP | 2004-305447 | A | 11/2004 |
| JP | 2004-321485 | A | 11/2004 |
| JP | 2006-288587 | A | 10/2006 |
| WO | 2014/049921 | A1 | 4/2014 |

OTHER PUBLICATIONS

Extended European Search Report dated Feb. 26, 2018, issued by the European Patent Office in corresponding European Application No. 15888533.5. (8 pages).
International Search Report (PCT/ISA/210) dated Nov. 24, 2015, by the Japanese Patent Office as the International Searching Authority for International Application No. PCT/JP2015/074876.
Written Opinion (PCT/ISA/237) dated Nov. 24, 2015, by the Japanese Patent Office as the International Searching Authority for International Application No. PCT/JP2015/074876.
Communication pursuant to Article 94(3) EPC dated May 14, 2019, by the European Patent Office in corresponding European Patent Application No. 15888533.5. (5 pages).
Communication pursuant to Article 94(3) EPC dated Nov. 13, 2019, by the European Patent Office in corresponding European Patent Application No. 15888533.5. (5 pages).
Communication pursuant to Article 94(3) EPC dated Nov. 3, 2019, by the European Patent Office in corresponding European Patent Application No. 15888533.5. (5 pages).
The extended European search report dated Apr. 20, 2020, by the European Patent Office in corresponding European Patent Application No. 20152998.9. (7 pages).

* cited by examiner

HAND DRYER

FIELD

The present invention relates to a hand dryer for users to dry their hands wet with water after washing the hands in hand wash, etc., in a powder room, a bathroom, a lavatory, or the like.

BACKGROUND

As a conventional hand dryer, for example, Patent Literature 1 describes a wall-mountable hand dryer which is configured to blow out a drying airflow through a nozzle (blow opening) toward a drying space so as to hit hands inserted in the drying space to dry the hands. Further, Patent Literature 2 describes a hand dryer having a reflecting plate provided below an airflow nozzle (discharge opening) with a drying space defined between the reflecting plate and the nozzle.

CITATION LIST

Patent Literature

Patent Literature 1: Japanese Utility Model Application Laid-open Publication No. H05-15896 (paragraph [0013], FIG. 1)

Patent Literature 2: Japanese Patent Application Laid-open Publication No. H09-56639 (paragraph [0019], FIG. 4)

SUMMARY

Technical Problem

The conventional hand dryers are installed such that the drying space is located lower than the shoulders of users so that the users easily insert their hands, and thus the hand inserted into the drying space from the front of the hand dryer inclines naturally such that the fingertips are lower than the wrist, so that the hand is in a position in which it extends obliquely downward toward the wall. Hence, in the conventional hand dryer described in Patent Literature 1, after the airflow blown out through the nozzle collides with the hand, most of the airflow after the collision advances along the hand toward the fingertips so as to advance obliquely downward toward the wall to which the hand dryer is mounted.

Then after colliding with the wall, the airflow divides into an airflow flowing downward along the wall and an airflow reflected by the wall and flowing obliquely downward toward the user (in an oblique direction between toward the front and downward). The airflow flowing downward along the wall reaches the floor and flows along the floor to the feet of the user. The airflow reflected by the wall to advance away from the wall obliquely downward toward the user, flows toward a lower body part of the user ranging from the waist to legs of the user. As such, because a lot of airflow hits the user's lower body part ranging from the waist to feet of the user during the use of the hand dryer, there is the problem that the user feels uncomfortable. Further, especially in winter or the like, when air temperature in the environment where the hand dryer is installed is low, there is the problem that the user feels further uncomfortable due to a cold wind feeling.

Further, in the conventional hand dryer described in Patent Literature 2, because the reflecting plate is located in a direction of flow of the airflow blown out from the nozzle, that part of the airflow blown out from the nozzle, which has not been subjected to collision with the hand, directly comes into collision with the reflecting plates, and thus causing a problem that noise occurs due to the collision.

The present invention was made in order to solve the above problems, and an object thereof is to provide a hand dryer that reduces the airflow flowing toward the user after collision with the hand and that reduces the airflow directly coming into collision with a wind direction changing part without having been subjected to collision with the hand, so as to achieve both a reduction in the uncomfortable feeling of the user due to the airflow hitting the body other than the hands and a reduction in noise.

Solution to Problem

In order to solve the above problems, and in order to attain the above object, a hand dryer according to a first aspect of the present invention includes: a nozzle for blowing out an airflow toward a drying space; and a wind direction changing part that changes a direction of the airflow blown out from the nozzle, wherein while the airflow is being blown out from the nozzle, the wind direction changing part and the nozzle do not directly face each other.

A hand dryer according to a second aspect of the present invention includes: a nozzle for blowing out an airflow toward a drying space; and a wind direction changing part that changes a direction of the airflow blown out from the nozzle, wherein while the airflow is being blown out from the nozzle, the wind direction changing part is not located on an extension of a blow direction of the nozzle.

A hand dryer according to a third aspect of the present invention includes: a nozzle for blowing out an airflow toward a drying space; and a wind direction changing part that changes a direction of the airflow blown out from the nozzle, wherein while the airflow is being blown out from the nozzle, the wind direction changing part is not located on an extension of a center axis of an air jet hole of the nozzle.

Advantageous Effects of Invention

The present invention can reduce the airflow flowing toward the user after collision with the hand and reduce the airflow directly coming into collision with the wind direction changing part without having been subjected to collision with the hand, so as to achieve both a reduction in the uncomfortable feeling of the user and a reduction in noise.

DESCRIPTION OF EMBODIMENTS

First Embodiment

Figure 1:
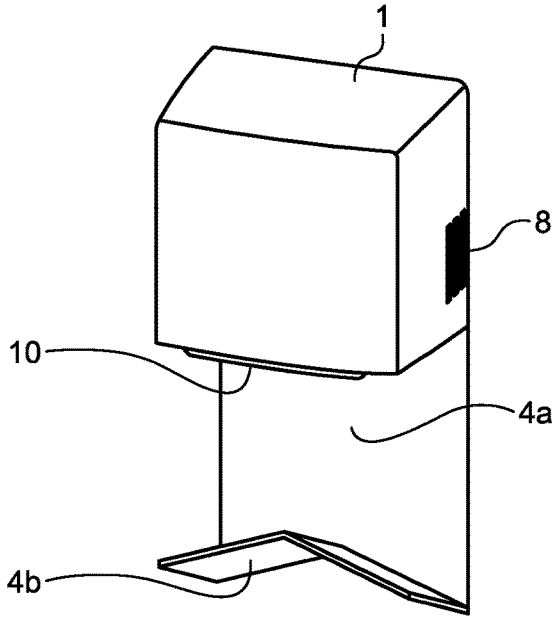
FIG. 1 is a perspective view of a hand dryer illustrated in a first embodiment of the present invention.
Figure 2:
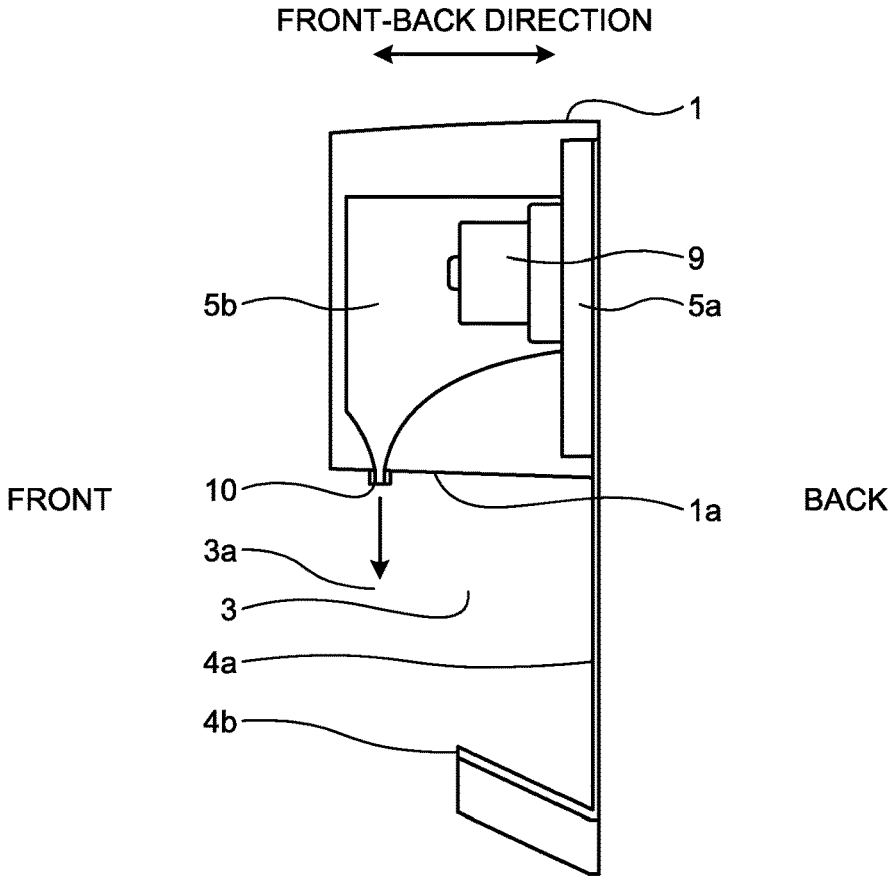
FIG. 2 is a right-side cross-sectional view of the hand dryer illustrated in the first embodiment of the present invention.
Figure 3:
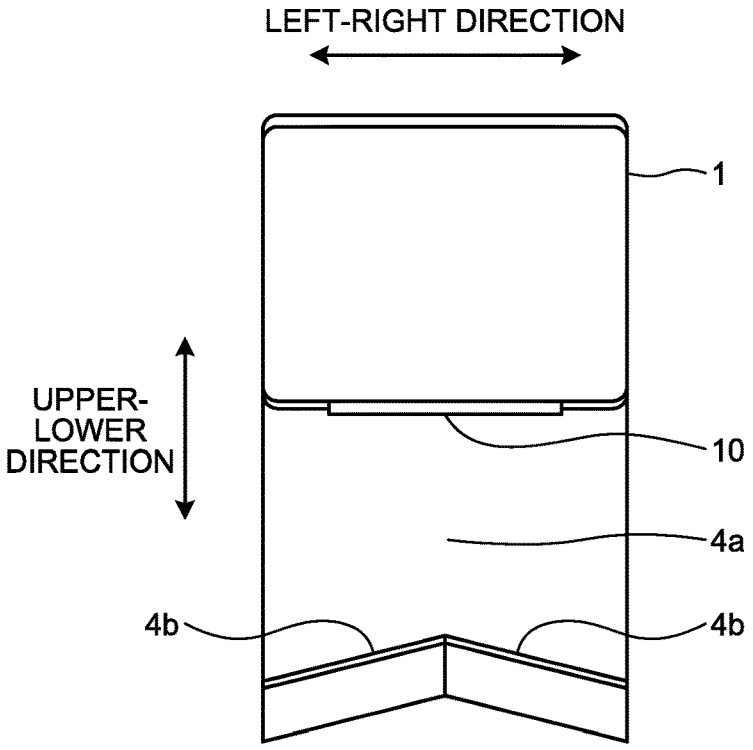
FIG. 3 is a front view of the hand dryer illustrated in the first embodiment of the present invention.

The first embodiment takes the form of a wall-mountable hand dryer that can be mounted to a wall. FIGS. 1 to 3 illustrate the hand dryer according to the first embodiment of the present invention, in which FIG. 1 is a perspective view illustrating the outer appearance of the hand dryer, FIG. 2 is a right-side cross-sectional view of the hand dryer, and FIG. 3 is a front view of the hand dryer. First, a front-back direction, a left-right direction, and an upper-lower direction described in the first embodiment will be defined. As to the front-back direction, the front (user side) of the hand dryer is referred to as "front", and the side opposite from the front is "back". As to the left-right direction, when the hand dryer is seen by a user standing in front of the front of the hand dryer, the right side is referred to as "right", and the left side is "left". As to the upper-lower direction, the upper side is referred to as "upper", and the lower side is "lower".

In FIGS. 1 to 3, a casing 1 forms an upper outer shell of the hand dryer. A drying space 3 having a drying space entrance 3*a* in its front is provided under the casing 1. The drying space 3 is a space which is open at the front and the left and right sides so that hands can be freely inserted and withdrawn. Further, a plane-shaped panel 4*a*, joined to and extending downward from a lower surface 1*a* of the casing 1, is provided at the back of the drying space 3. A wind direction changing part 4*b*, joined to the panel 4*a* and extending forward, is provided at a lower end of the panel 4*a*. The wind direction changing part 4*b* is constituted by a plate-shaped piece and extends from the panel 4*a* obliquely forward and upward (in an oblique direction between forward and upward) so as to rise as it goes forward. The wind direction changing part 4*b*, in front view, slopes obliquely downward such that both its outward sides along the left-right direction are lower than the center along the left-right direction. The drying space 3 is an open space partially surrounded by the lower surface 1*a* of the casing 1, the panel 4*a*, and the wind direction changing part 4*b*. The panel 4*a* and the wind direction changing part 4*b* are integrally formed.

A nozzle 10 is provided near a front end of the lower surface 1*a* of the casing 1 so as to protrude downward from the lower surface 1*a*. Air inlets 8 are provided in left and right opposite side surfaces of the casing 1. Air ducts 5*a* and 5*b* connecting the air inlets 8 and the nozzle 10 are provided inside the casing 1, and a high-pressure airflow generating device 9 to generate a high-pressure airflow is incorporated between the air ducts 5*a* and 5*b*.

The nozzle 10 is open vertically downward. The positional relation between the nozzle 10 and the wind direction changing part 4*b* will be described. The wind direction changing part 4*b* is so positioned as to be offset or shifted rearward in the front-back direction from a position on an extension of a blow direction (of a high-speed airflow) from the nozzle 10. That is, an extension line of the blow direction of the nozzle 10 and the wind direction changing part 4*b* do not intersect and are in a positional relation where they are offset from each other with the wind direction changing part 4*b* not being located at a position on an extension of the blow direction of the nozzle 10. Here, the blow direction of the nozzle 10 refers to a direction in which the high-speed airflow is blown out from the nozzle 10 and is the same as a direction of the airflow immediately after blown out from the nozzle 10.

Figure 4:
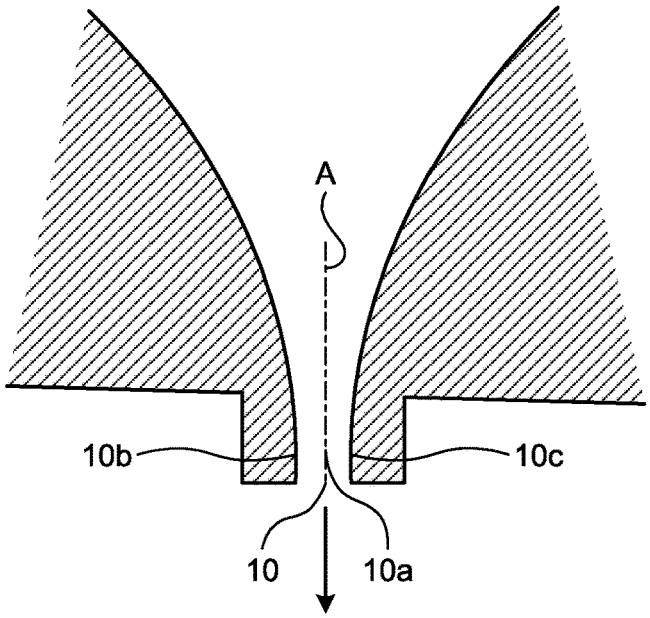
FIG. 4 is an enlarged right-side cross-sectional view of a nozzle in FIG. 2 of the hand dryer illustrated in the first embodiment of the present invention.

FIG. 4 is an enlarged right-side cross-sectional view of the nozzle 10 in FIG. 2. An air jet hole 10*a* is a narrow passage through which the airflow to be blown out from the nozzle 10 passes. The air jet hole 10*a* becomes narrower as it goes from an upstream side to a downstream side (exit) of the airflow passing therethrough. In a side cross-section taken along a plane extending in the front-back direction and vertically through the air jet hole 10*a* of the nozzle 10, inner walls 10*b* and 10*c* are opposite inner walls of the air jet hole 10*a* along the front-back direction. As illustrated in FIG. 4, a straight line passing between the inner walls 10*b* and 10*c* and obtained by joining points at equal distances from the inner walls 10*b* and 10*c* is called a center axis A. The wind direction changing part 4*b* is positioned with a rearward shift in the front-back direction from a position on an extension of the center axis A of the air jet hole 10*a*.

An opening that is an exit opening end of the air jet hole 10*a* of the nozzle 10 does not directly face the wind direction changing part 4*b* and is offset in the front-back direction from the wind direction changing part 4*b*. Thus, when the hand dryer is mounted to a wall of a room such as a toilet, the opening of the nozzle 10 directly faces the floor of the room, so that the blow direction of the nozzle 10 is oriented toward that floor. That is, when projected along a vertical direction that is the blow direction of the high-speed airflow, the position of the opening of the nozzle 10 does not overlap the position of the wind direction changing part 4*b*, and the wind direction changing part 4*b* is so positioned as to be offset or shifted rearward from the opening of the nozzle 10.

Figure 5:
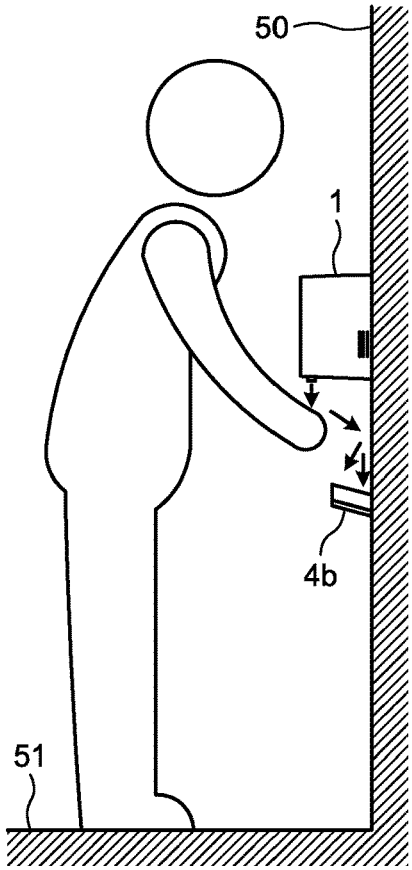
FIG. 5 is an explanatory view illustrating the state where a user is using the hand dryer illustrated in the first embodiment of the present invention.
Figure 6:
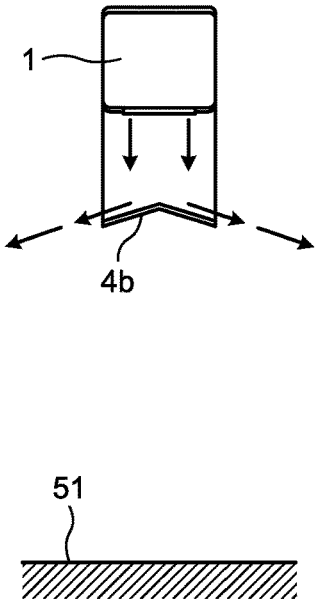
FIG. 6 is an explanatory view illustrating the state where a user is using the hand dryer illustrated in the first embodiment of the present invention.
Figure 7:
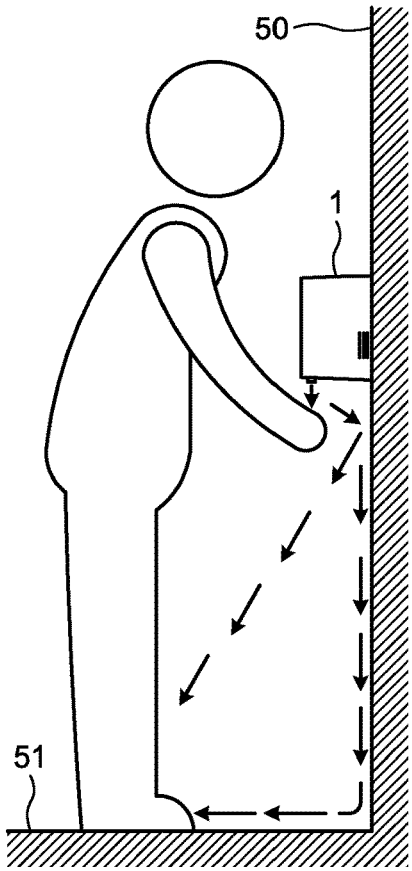
FIG. 7 is an explanatory view illustrating the state where a user is using a conventional hand dryer.
Figure 8:
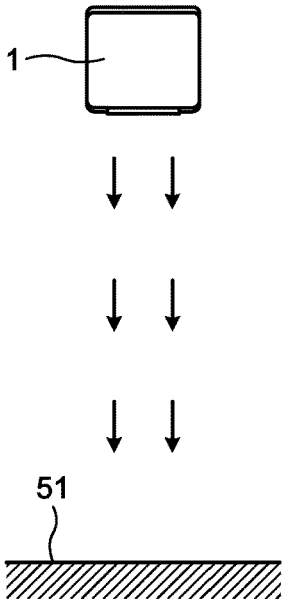
FIG. 8 is an explanatory view illustrating the state where a user is using the conventional hand dryer.

Next, the flow of air and the flow of water droplets while the hand dryer is operating will be described. FIGS. 5 and 6 are explanatory views illustrating the state where a user is using the hand dryer of the first embodiment mounted to a wall. FIGS. 7 and 8 are explanatory views illustrating a conventional hand dryer not having the wind direction changing part 4*b* and the state where a user is using the conventional hand dryer mounted to a wall. As illustrated in FIGS. 5 and 6, the hand dryer of the first embodiment is mounted to a wall 50 of a room such as a toilet. When a user stands in front of the hand dryer and inserts wet hands into the drying space 3 through the drying space entrance 3*a*, a hand detecting sensor (not illustrated) for detecting the presence/non-presence of hands in the drying space 3 detects the hands. Then the hand detecting sensor (not illustrated) detecting hands causes the high-pressure airflow generating device 9 to operate so that external air is sucked into the air duct 5*a* through the air inlet 8 and the sucked-in air is converted into a high-pressure airflow by the high-pressure airflow generating device 9. Then the converted high-pressure airflow passes through the air duct 5*b* and is converted into a high-speed airflow by the nozzle 10 so as to be blown downward along a vertical direction as a high-speed airflow at 60 m/s or greater from the nozzle 10 toward the drying space 3. Although, as the speed of the high-speed airflow increases, jet noise produced from the nozzle 10 also increases, the speed of the high-speed airflow should be set at 100 m/s or greater, more preferably 150 m/s or greater if shortening of the drying time is given higher priority irrespective of an increase in jet noise.

The hand dryer is installed such that the drying space 3 is located lower than the shoulders of users so that the users easily insert their hands, and thus the hand inserted into the drying space 3 from the front inclines naturally such that the fingertips are lower than the wrist, so that the hand is in a position in which it extends obliquely downward toward the back (in an oblique direction between backward and vertically downward). Then the high-speed airflow blown vertically downward from the nozzle 10 collides at an angle with the hands inserted inclining obliquely downward toward the back. Thus, most of the collided high-speed airflow changes into an airflow advancing along the hands toward the fingertips, that is, an airflow advancing obliquely downward toward the back. In the direction referred to by the "obliquely downward toward the back", there are the panel 4*a* and the wind direction changing part 4*b*, so that the airflow advancing obliquely downward toward the back, flows toward the panel 4*a* and the wind direction changing part 4*b*. Water sticking to the hands is separated from the hands by the airflow colliding with the hands and is blown away toward the panel 4*a* and the wind direction changing portion part 4*b* by the airflow advancing obliquely downward toward the back.

The airflow reaching the panel 4*a* is divided by collision with the panel 4*a* into an airflow flowing downward along the panel 4*a* and an airflow reflected by the panel 4*a* to flow obliquely downward toward the front. The airflow flowing downward along the panel 4*a* reaches the wind direction changing part 4*b* and is divided, by collision with the wind direction changing part 4*b*, into two parts, leftward and rightward outward parts so that the direction of the airflow is changed into a leftward oblique downward direction and a rightward oblique downward direction. The airflow reflected by the panel 4*a* to advance away from the panel 4*a* obliquely downward toward the front, also reaches the wind direction changing part 4*b* extending forward, and the direction of this airflow is changed likewise into a leftward oblique downward direction and a rightward oblique downward direction by collision with the wind direction changing part 4*b*. Further, out of the airflow advancing obliquely downward toward the back due to collision with the inserted hand, an airflow toward the wind direction changing part 4*b*, not the panel 4*a*, also has its flow direction changed likewise into a leftward oblique downward direction and a rightward oblique downward direction by collision with the wind direction changing part 4*b*.

On the other hand, water separated from the hands and blown away to reach the panel 4*a* or the wind direction changing part 4*b*, flows down along the surface of the panel 4*a* or the wind direction changing part 4*b* and further flows down to a floor 51 along the wall 50 to which the hand dryer is mounted.

The nozzle 10 has an elongated slot-shaped opening extending in the left-right direction, so that the high-speed airflow blown out from the nozzle 10 is elongated extending in the left-right direction. The high-speed airflow blown out from the nozzle 10 is formed to have an enough transverse width with respect to the width of the inserted hands, so that the high-speed airflow sufficiently hits the inserted hands without being affected by the width and transverse location of the inserted hands. Water sticking to the hands is separated and blown away from the hands by the high-speed airflow blown out from the nozzle 10. Then while the high-speed airflow is being blown out from the nozzle 10, the user slowly withdraws the hands inserted in the drying space 3, so that the collision position of the high-speed airflow from the nozzle 10 on the surface of the inserted hands gradually moves from the wrist side to the fingertip side, and thus water on the entire hand is blown away.

A length of the nozzle 10 in the left-right direction should be 80 mm or greater if one hand is to be dried, 150 mm or greater if both hands are to be simultaneously dried, and more preferably 200 mm or greater. If the nozzle 10 is divided into a plurality of parts along the left-right direction, a combined length of the divided parts of the nozzle 10 is taken to be the entire length in the left-right direction of the divided nozzle 10. The slot width of the nozzle 10 is preferably 2 mm or less for obtaining a high-speed airflow.

Out of the high-speed airflow blown out from the nozzle 10, a high-speed airflow not having been subjected to collision with the inserted hands is allowed to advance vertically downward while keeping its flow direction unchanged and its flow speed less attenuated because of no collision with the hands. Then because the wind direction changing part 4*b* is not present in its advancing direction, the high-speed airflow is allowed to pass through the vicinity of the wind direction changing part 4*b* without colliding with the wind direction changing part 4*b* and flows vertically downward toward the floor 51.

For comparison, a description will be made about the flow of air occurring when a user is using the conventional hand dryer not equipped with the wind direction changing part 4*b*. As illustrated in FIGS. 7 and 8, the airflow changed in its direction of flow by collision with the hands to advance obliquely downward toward the back so as to advance toward the wall 50, reaches the wall 50 and is divided by collision with the wall 50 into an airflow flowing downward along the wall 50 and an airflow reflected by the wall 50 to flow obliquely downward toward the front. The airflow flowing downward along the wall 50 reaches the floor 51 and flows along the floor 51 to the feet of the user. The airflow reflected by the wall 50 to advance away from the wall 50 obliquely downward toward the front flows toward a user's lower body part ranging from around the waist to legs of the user.

In the hand dryer having the above configuration, the wind direction changing part 4*b* is so positioned as to be offset or shifted rearward in the front-back direction from a position on an extension of the blow direction (of a high-speed airflow) from the nozzle 10. An extension line of the blow direction of the nozzle 10 and the wind direction changing part 4*b* do not intersect, and the wind direction changing part 4*b* is not located at a position on an extension of the blow direction of the nozzle 10 but located with a rearward offset therefrom. The wind direction changing part 4*b* is so positioned as to be shifted rearward in the front-back direction from a position on an extension of the center axis A of the air jet hole 10*a*. The opening that is the exit opening end of the air jet hole 10*a* of the nozzle 10 does not directly face the wind direction changing part 4*b* and is offset therefrom in the front-back direction.

Because the wind direction changing part 4*b* is not located in the advancing direction of a high-speed airflow not having been subjected to a change in direction of flow due to collision with the inserted hands (e.g., a high-speed airflow located transversely outward of the inserted hands), such a part of the high-speed airflow blown out from the nozzle 10, which has not been subjected to collision with the hands, is allowed to pass through the vicinity of the front of the wind direction changing part 4*b* with almost not colliding with the wind direction changing part 4*b* either. As such, because such a part of the high-speed airflow blown out from the nozzle 10 and not subjected to collision with the hands does not undergo direct collision with the wind direction changing part 4*b*, noise produced by collision of a high-speed airflow and the wind direction changing part 4*b* can be suppressed, so that noise during the use of the hand dryer can be reduced. Especially the high-speed airflow not subjected to a change in direction of flow due to collision with the hands maintains a high speed without wind-speed attenuation due to collision, and thus, collision with the wind direction changing part 4*b* would produce conspicuous noise, but noise can be effectively reduced by avoiding direct collision of the high-speed airflow with the wind direction changing part 4*b*.

In contrast, out of the high-speed airflow blown out vertically downward from the nozzle 10, the high-speed airflow having collided with the inserted hands has its flow direction changed due to the collision so as to change into an airflow advancing along the hands toward the fingertips to flow obliquely downward toward the back, thus toward the panel 4*a* and the wind direction changing part 4*b*. Then the airflow toward the panel 4*a* and the airflow toward the wind direction changing part 4*b* both reach the wind direction changing part 4*b*, and their flow directions change into a leftward oblique downward direction and a rightward oblique downward direction due to collision with the wind direction changing part 4*b*. Then these airflows advance along the wall leftward obliquely downward and rightward obliquely downward and flow along the floor toward the front where the user is standing. However, because these airflows have been divided laterally outward in the left-right direction with respect to the user, they do not reach the front of the user but pass by the user. Thus, since no airflow hits the legs of the user, the cold wind feeling of the user at the feet can be reduced, especially in winter or the like, when air temperature in the environment where the hand dryer is installed is low.

Further, the airflow reflected by the panel 4*a* to advance away from the panel 4*a* obliquely downward toward the front, also collides with the wind direction changing part 4*b* extending forward, so that the direction of the airflow is changed likewise into a leftward oblique downward direction and a rightward oblique downward direction. Thus, the airflow reflected by the panel 4*a* to advance away from the panel 4*a* obliquely downward toward the front is prevented from keeping on advancing straight to hit a lower body part ranging from the waist to legs of the user, so that the uncomfortable feeling or cold wind feeling of the user can be reduced.

Further, since the wind direction changing part 4*b* extends obliquely upward toward the front so as to rise as it goes toward the front, a speed component of the airflow advancing forwards after collision with the wind direction changing part 4*b* can be effectively reduced, and the uncomfortable feeling or cold wind feeling of the user can be effectively reduced.

As such, the wind direction changing part 4*b* can have general selectivity that it receives an airflow having been subjected to a change in direction of flow due to collision with the hand (an airflow possibly hitting the lower body part or the like of the user) and changes its flow direction to avoid the user and that it hardly directly receives a high-speed airflow having collided with nothing after blown out from the nozzle, and thus both a reduction in wind hitting the user and a reduction in noise can be achieved by the wind direction changing part 4*b*.

In the hand dryer, when the hands are pulled out of the drying space 3, the high-pressure airflow generating device 9 is stopped by the hand detecting sensor (not illustrated) to stop blowing the high-speed airflow out from the nozzle 10. In order to certainly dry up to the fingertips, after having the high-speed airflow certainly hit up to the fingertips of the inserted hands, the high-speed airflow needs to be stopped, but it is difficult to accurately detect the positions of the fingertips by the hand detecting sensor (not illustrated). Accordingly, in general, a delayed operation is provided such that the hand dryer is made to keep blowing out the high-speed airflow for about 0.5 to 2 sec even after the hand detecting sensor (not illustrated) detects that the hands have been pulled out of the drying space 3 and then to stop blowing out the high-speed airflow, and thus blowing out the high-speed airflow is stopped after having the high-speed airflow certainly hit up to the fingertips.

In this delayed operation, after the hands are pulled out of the drying space 3, the high-speed airflow continues blowing out from the nozzle 10 while hands are not inserted in the drying space 3, so that noise associated with the operation of the hand dryer continues for a while even after a user finishes drying. For users, noise in drying associated with the operation for themselves is likely to be tolerable, but, because of not being directly connected with the drying of the user, noise after finishing drying is difficult to tolerate even if the noise occurs for a short time of about 0.5 to 2 sec, so that the user feels very uncomfortable. However, although the present invention provides the above delayed operation, in which the high-speed airflow continues to be blown out from the nozzle 10 while hands are not inserted in the drying space 3, because the high-speed airflow does not directly collide with the wind direction changing part 4*b*, uncomfortable noise not directly connected with the drying for the user can be reduced.

Figure 9:
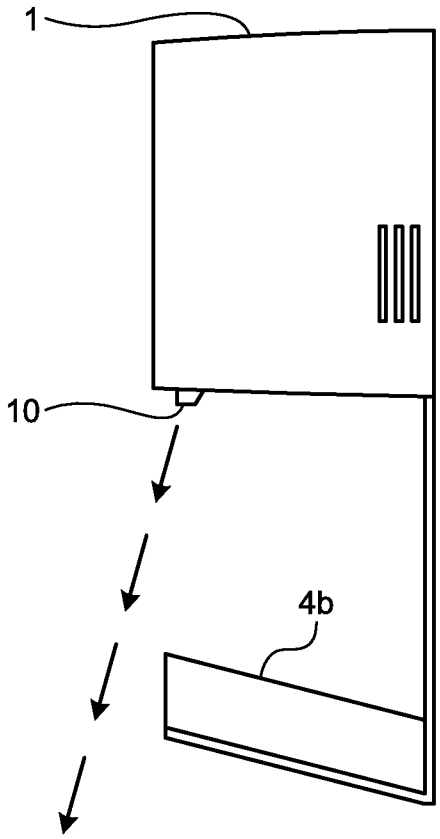
FIG. 9 is a right side view illustrating another practical example of the hand dryer illustrated in the first embodiment of the present invention.
Figure 10:
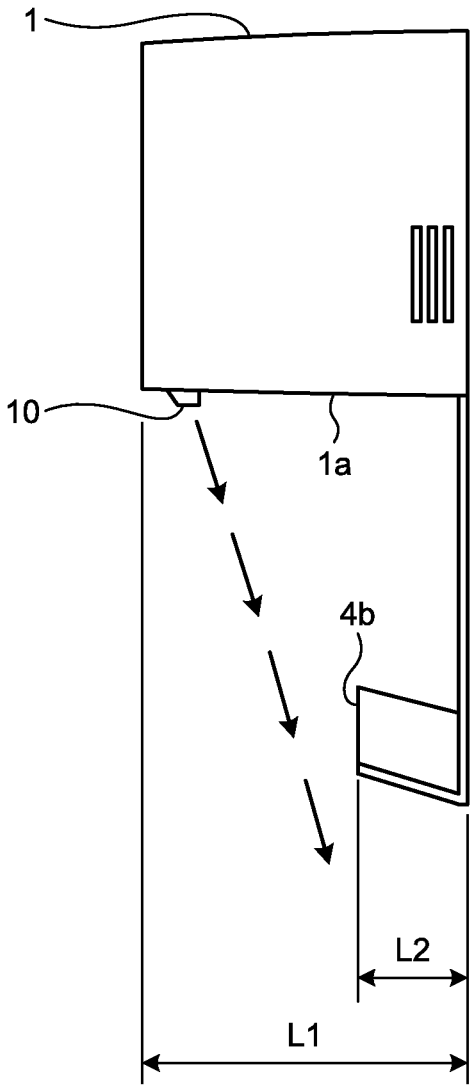
FIG. 10 is a right side view illustrating still another practical example of the hand dryer illustrated in the first embodiment of the present invention.
Figure 11:
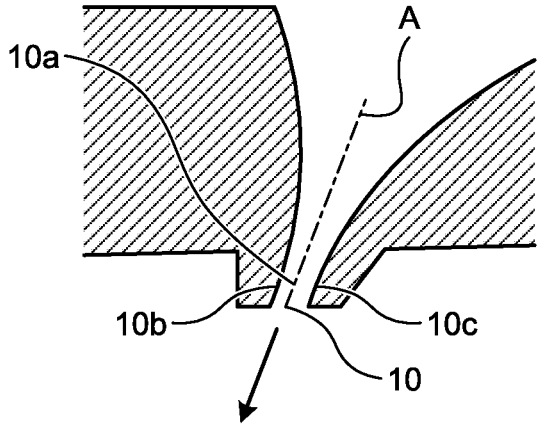
FIG. 11 is an enlarged right side cross-sectional view of a nozzle in FIG. 9 of the other practical example of the hand dryer illustrated in the first embodiment of the present invention.
Figure 12:
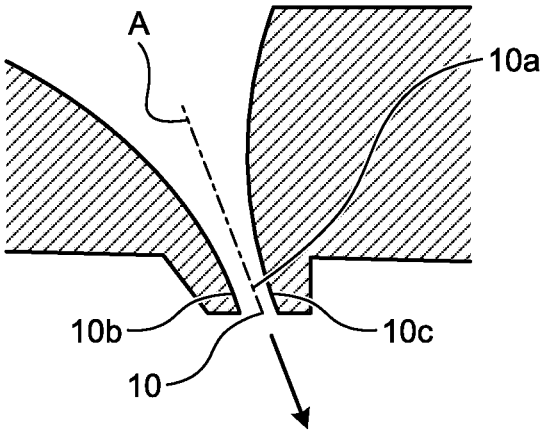
FIG. 12 is an enlarged right side cross-sectional view of a nozzle in FIG. 10 of the other practical example of the hand dryer illustrated in the first embodiment of the present invention.

Although the first embodiment describes that the blow direction of the high-speed airflow from the nozzle 10 is vertically downward, the blow direction of the high-speed airflow from the nozzle 10, not being limited to this, may be at an angle whether forward, backward, leftward, or rightward as long as being downward. For example, FIGS. 9 and 10 are right side views illustrating other practical examples of the hand dryer of the first embodiment concerning the blow direction of the high-speed airflow from the nozzle 10. FIG. 11 is an enlarged right side cross-sectional view of the nozzle 10 in FIG. 9. FIG. 12 is an enlarged right side cross-sectional view of the nozzle 10 in FIG. 10. In FIGS. 9 and 11, the blow direction of the nozzle 10 is obliquely downward toward the front (in an oblique direction between toward the front and downward) rather than in a vertical direction, and in FIGS. 10 and 12, the blow direction of the nozzle 10 is obliquely downward toward the back (in an oblique direction between toward the back and downward) rather than in a vertical direction.

The hand dryers illustrated in FIGS. 9, 10, 11, and 12 have the above effects, and in addition since the blow direction of the nozzle 10 is obliquely downward toward the front (in an oblique direction between toward the front and vertically downward) rather than in a vertical direction in FIGS. 9 and 11, the size along the front-back direction of the drying space 3 can be greater than the size along the front-back direction of the hand dryer. Thus, with securing an enough size along the front-back direction of the drying space 3 for the inserted hands, the size along the front-back direction of the hand dryer can be decreased. Further, even if, along the front-back direction, the front end of the wind direction changing part 4*b* is located at the same position as, or in front of, the nozzle 10, the nozzle 10 does not face the wind direction changing part 4*b*, and hence users can be further prevented from being hit with the airflow.

In contrast, in the hand dryer of FIGS. 10 and 12, wind bouncing back to the user can be reduced.

Although the first embodiment shows an example in which the wind direction changing part 4*b* is placed such that its front end is located in front of a position at a distance of ½ of L1 so that L2>½×L1 is satisfied, where, along the front-back direction, L1 is the distance between the front end and a back or rear end of the lower surface 1*a* of the casing 1 and L2 is the distance between the front end of the wind direction changing part 4*b* and the rear end of the lower surface 1*a* of the casing 1, if, as illustrated in FIG. 10, with the blow direction of the nozzle 10 being made obliquely backward, the wind direction changing part 4*b* is placed such that its front end is located rearward of the position at a distance of ½ of the distance L1 between the front end and the rear end of the lower surface 1*a* of the casing 1 so that L2≤½× L1 is satisfied, the length over which the wind direction changing part 4*b* extends forward will be further shorter. Therefore, when a user inserts the hands into the drying space 3, it is difficult for the user to see the wind direction changing part 4*b* due to the presence of the casing 1, so that the user feels that the drying space 3 is large, and thus a feeling of psychological oppression when inserting the hands into the drying space 3 can also be reduced.

Figure 13:
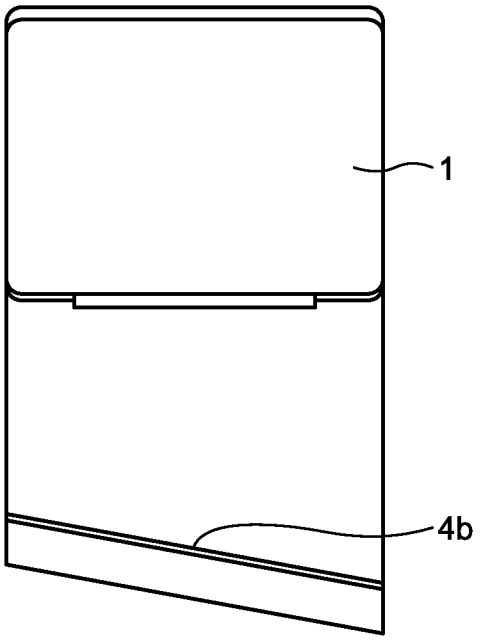
FIG. 13 is a front view illustrating another practical example of the hand dryer illustrated in the first embodiment of the present invention.
Figure 14:
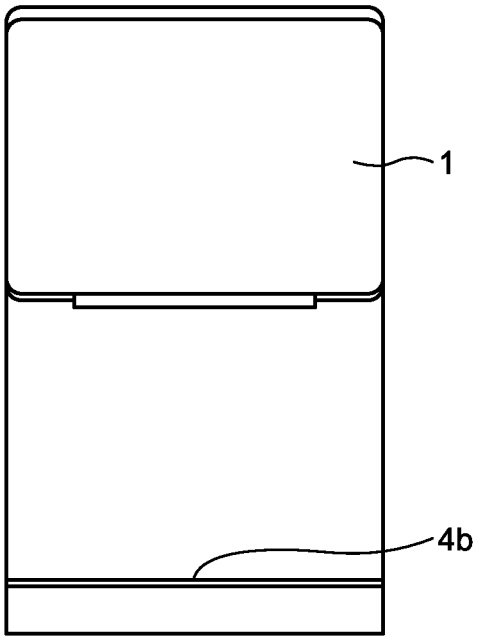
FIG. 14 is a front view illustrating still another practical example of the hand dryer illustrated in the first embodiment of the present invention.

Although the first embodiment illustrates a particular shape of the wind direction changing part 4*b* in which the wind direction changing part 4*b* is substantially bilaterally symmetric in front view and slopes obliquely downward such that both outward sides along the left-right direction are lower than the center thereof, the shape of the wind direction changing part 4*b* is not limited to this. FIGS. 13 and 14 are front views illustrating other practical examples of the wind direction changing part 4*b* of the hand dryer of the first embodiment. As illustrated in FIG. 13, the wind direction changing part 4*b* may incline in one direction as a whole so that one side is lower than the other side. Alternatively, as illustrated in FIG. 14, with the design and production cost being given higher priority, the wind direction changing part 4*b* may be horizontal without inclining along the left-right direction in front view. In this case, as compared with the case where the wind direction changing part 4*b* inclines, the effect of dividing the airflow into leftward and rightward directions is reduced, but the airflow advances leftward and rightward in certain amounts, and also the wind speed itself of the airflow can be made slower by collision with the wind direction changing part 4*b*, so that the airflow toward the user can be reduced likewise. Although the first embodiment shows an example where the leftward and rightward sloping sides of the wind direction changing part 4*b* are formed by inclining planes, they may be formed by curved surfaces.

Although the first embodiment shows an example in which the panel 4*a* is in a plane shape of substantially the same width along the left-right direction as the casing 1, the shape is not limited to that as long as the casing 1 and the wind direction changing part 4*b* can be connected. Thus, the panel 4*a* may be smaller in width along the left-right direction than the casing 1 and may be in a curved shape, not planar and may be constituted by elongated poles or the like, not in a plane shape.

Although the first embodiment shows an example in which the wind direction changing part 4*b* is constituted by a piece in a planar plate shape, the thickness of the plate may vary instead of being even, and the wind direction changing part 4*b* may be in a curved shape, not combined planes, not being limited to a particular one.

The material of the panel 4*a* and the wind direction changing part 4*b* may be metal, resin, or the like, not being limited to a particular material.

Where a hand dryer is mounted to a wall, if the hand dryer is one whose depth along the front-back direction is 100 mm or less, it can be compliant with the Americans with Disabilities Act 1990 (ADA), so that the hand dryer need not be embedded in the wall. However, if the depth of the hand dryer is 100 mm or less, because the airflow, after collision with the hand, advancing obliquely downward along the hand toward the fingertips can collide with the panel 4*a* without being subjected to force attenuation, the airflow reflected by the panel 4*a* to advance obliquely downward toward the front will hit the user while keeping its force still strong. That is, as the depth of the hand dryer becomes smaller so as to be closer to the wall, wind hits the user more strongly. Thus, according to the invention of the first embodiment, as the depth of the hand dryer becomes smaller, the effect of preventing wind hitting the user becomes more conspicuous, and it is more preferable to carry out the first embodiment with the depth of the hand dryer being 100 mm or less, which can obtain further greater effect.

Second Embodiment

Figure 15:
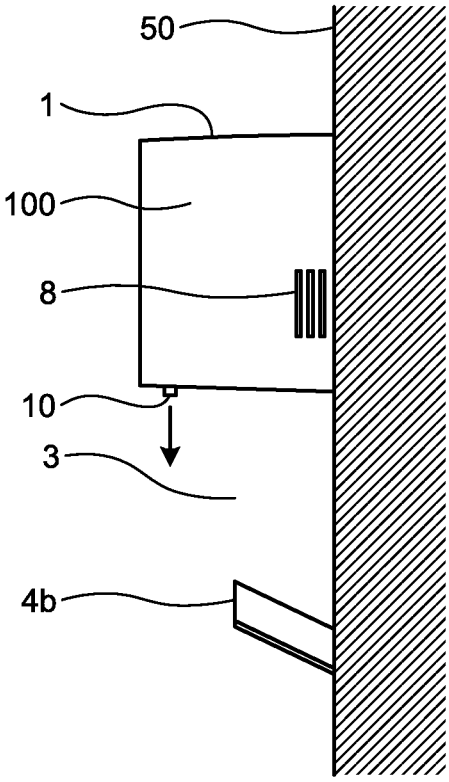
FIG. 15 is a right side view of a hand dryer illustrated in a second embodiment of the present invention.
Figure 16:
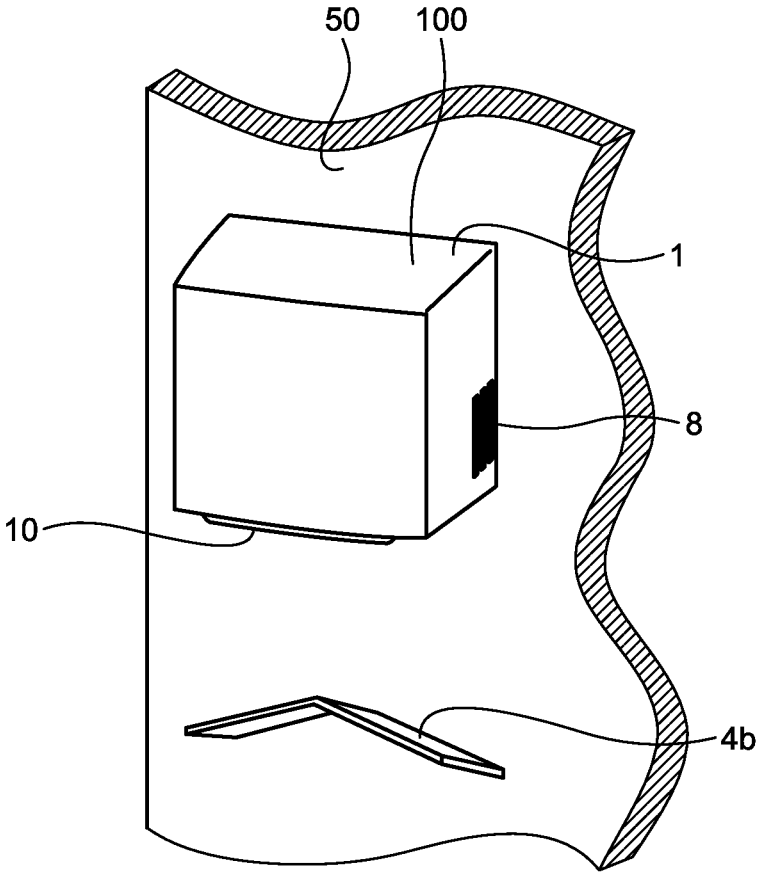
FIG. 16 is a perspective view of the hand dryer illustrated in the second embodiment of the present invention.

The second embodiment takes the form of a hand dryer mountable to a wall. FIGS. 15 and 16 illustrate the state where the hand dryer shown in the second embodiment of the present invention is mounted to a wall 50 in which FIG. 15 is a right side view of the hand dryer, and FIG. 16 is a perspective view of the hand dryer. In FIGS. 15 and 16, an air inlet 8, air ducts 5*a* and 5*b*, a high-pressure airflow generating device 9, and a nozzle 10 are provided in a casing 1 as in the first embodiment, but the air ducts 5*a* and 5*b* and the high-pressure airflow generating device 9 provided inside the casing 1 are omitted from illustration in these figures. The casing 1, the air inlet 8, the air ducts 5*a* and 5*b*, the high-pressure airflow generating device 9, and the nozzle 10 are combined into a blower unit 100 that is a single unit having a blower function. In the second embodiment, the casing 1 and the wind direction changing part 4*b* are independent of each other. That is, the blower unit 100 and the wind direction changing part 4*b* are independent of each other. Thus, the blower unit 100 and the wind direction changing part 4*b* are attached to the wall 50 to which the hand dryer is to be mounted, such that the wind direction changing part 4*b* is placed below the blower unit 100. The second embodiment differs from the first embodiment only in that the blower unit 100 and the wind direction changing part 4*b* are independent of each other without a panel 4*a* and is the same in configuration as the first embodiment except that.

The hand dryer having the above configuration has the same effects as in the first embodiment, and the position of the wind direction changing part 4*b* can be adjusted for installation according to the environment where the hand dryer is to be mounted and users.

Although the second embodiment shows an example in which the panel 4*a* is not provided, the panel 4*a* integral with the wind direction changing part 4*b* may be provided.

Note that the arrows shown in FIGS. 2, 4 to 12 and 15 indicate the directions of airflows (except a double arrow indicating front-back directions in FIG. 2 and double arrows indicating sizes L1 and L2 in FIG. 10).

REFERENCE SIGNS LIST

1 casing, 1*a* lower surface, 3 drying space, 3*a* drying space entrance, 4*a* panel, 4*b* wind direction changing part, 5*a*, 5*b* air duct, 8 air inlet, 9 high-pressure airflow generating device, 10 nozzle, 10*a* air jet hole, 10*b*, 10*c* inner wall, 50 wall, 51 floor, 100 blower unit.

The invention claimed is:

1. A hand dryer comprising:

an upper portion and a lower portion, the lower portion extending from a lower-most end of the upper portion to a lower-most end of the hand dryer, the upper portion extending to a first front-most end of the hand dryer at the upper portion, and the lower portion extending to a second front-most end of the hand dryer at the lower portion, a nozzle located at the upper portion of the hand dryer and configured to blow out an airflow toward a drying space, from a start of an airflow blowing operation to an end of the airflow blowing operation; and a wind direction changing part configured to change a direction of the airflow blown out from the nozzle into the drying space, the wind direction changing part being located at the lower portion of the hand dryer and extending to the second front-most end of the hand dryer at the lower portion, wherein, in a front view of the hand dryer, the wind direction changing part slopes obliquely toward at least one lateral side of the wind direction changing part, and wherein while the airflow is being blown out from the nozzle, at least at the start of the airflow blowing operation, the wind direction changing part and the nozzle do not directly face each other.

2. The hand dryer according to claim 1, wherein the drying space is open at least at the front, and the wind direction changing part is located rearward of the nozzle.

3. The hand dryer according to claim 1, wherein the nozzle is provided in a casing forming an outer shell, and the wind direction changing part is placed rearward of, and does not extend beyond, a position at a distance of half of a distance between a first front-most end of the casing and a rear-most end of the casing along a front-back direction.

4. The hand dryer according to claim 3, wherein the size along the front-back direction of the casing is 100 mm or less.

5. A hand dryer comprising:

an upper portion and a lower portion, the lower portion extending from a lower-most end of the upper portion to a lower-most end of the hand dryer, the upper portion extending to a first front-most end of the hand dryer at the upper portion, and the lower portion extending to a second front-most end of the hand dryer at the lower portion, a nozzle located at the upper portion of the hand dryer and configured to blow out an airflow toward a drying space, from a start of an airflow blowing operation to an end of the airflow blowing operation; and a wind direction changing part configured to change a direction of the airflow blown out from the nozzle into the drying space, the wind direction changing part being located at the lower portion of the hand dryer and extending to the second front-most end of the hand dryer at the lower portion, wherein, in a front view of the hand dryer, the wind direction changing part slopes obliquely toward at least one lateral side of the wind direction changing part, and wherein while the airflow is being blown out from the nozzle, at least at the start of the airflow blowing operation, the wind direction changing part is not located on an extension of a blow direction of the nozzle.

6. The hand dryer according to claim 5, wherein the drying space is open at least at the front, and the wind direction changing part is located rearward of the extension of the blow direction of the nozzle.

7. The hand dryer according to claim 5, wherein the nozzle is provided in a casing forming an outer shell, and the wind direction changing part is placed rearward of, and does not extend beyond, a position at a distance of half of a distance between a first front-most end of the casing and a rear-most end of the casing along a front-back direction.

8. The hand dryer according to claim 7, wherein the size along the front-back direction of the casing is 100 mm or less.

9. A hand dryer comprising:

an upper portion and a lower portion, the lower portion extending from a lower-most end of the upper portion to a lower-most end of the hand dryer, the upper portion extending to a first front-most end of the hand dryer at the upper portion, and the lower portion extending to a second front-most end of the hand dryer at the lower portion, a nozzle located at the upper portion of the hand dryer and configured to blow out an airflow toward a drying space, from a start of an airflow blowing operation to an end of the airflow blowing operation; and a wind direction changing part configured to change a direction of the airflow blown out from the nozzle into the drying space, the wind direction changing part being located at the lower portion of the hand dryer and extending to the second front-most end of the hand dryer at the lower portion, wherein, in a front view of the hand dryer, the wind direction changing part slopes obliquely toward at least one lateral side of the wind direction changing part, and wherein while the airflow is being blown out from the nozzle, at least at the start of the airflow blowing operation, the wind direction changing part is not located on an extension of a center axis of an air jet hole of the nozzle.

10. The hand dryer according to claim 9, wherein the drying space is open at least at the front, and the wind direction changing part is located rearward of the extension of the center axis of the air jet hole.

11. The hand dryer according to claim 9, wherein the nozzle is provided in a casing forming an outer shell, and the wind direction changing part is placed rearward of, and does not extend beyond, a position at a distance of half of a distance between a first front-most end of the casing and a rear-most end of the casing along a front-back direction.

12. The hand dryer according to claim 11, wherein the size along the front-back direction of the casing is 100 mm or less.

* * * * *